US006110299A

United States Patent [19]

Tosaka et al.

[11] Patent Number: 6,110,299

[45] Date of Patent: Aug. 29, 2000

[54] STEEL SHEET FOR DOUBLE WOUND PIPE AND METHOD OF PRODUCING THE PIPE

[75] Inventors: Akio Tosaka; Kaneharu Okuda; Masatoshi Aratani, all of Chiba, Japan

[73] Assignee: Kawasaki Steel Corporation, Hyogo, Japan

[21] Appl. No.: 09/091,745

[22] PCT Filed: Nov. 25, 1997

[86] PCT No.: PCT/JP97/04289

§ 371 Date: Jun. 24, 1998

§ 102(e) Date: Jun. 24, 1998

[87] PCT Pub. No.: WO98/24942

PCT Pub. Date: Jun. 11, 1998

[30] Foreign Application Priority Data

Dec. 6, 1996 [JP] Japan ..... 8-326697

[51] Int. Cl.[7] ..... C22C 38/14; C22C 38/12; C21D 8/02

[52] U.S. Cl. ..... 148/320; 148/603

[58] Field of Search ..... 148/603, 320

[56] References Cited

U.S. PATENT DOCUMENTS 3,849,209 11/1974 Ishizaki et al. .
4,504,326 3/1985 Tokunaga et al. ..... 148/603
4,675,650 6/1987 Coppersmith et al. .
4,889,566 12/1989 Okada et al. .
5,089,068 2/1992 Okada et al. .
5,356,494 10/1994 Okada et al. .
5,360,676 11/1994 Kuguminato et al. .
5,496,420 3/1996 Kuguminato et al. .

FOREIGN PATENT DOCUMENTS 403257124 11/1991 Japan ..... 148/603

*Primary Examiner*—Deborah Yee
*Attorney, Agent, or Firm*—Young & Thompson

[57] ABSTRACT

A steel sheet for double-rolled tubes has excellent formability, and excellent strength and toughness after forming and heat treatment of a tube because of suppressed coarsening of the ferrite grain size and a method for making the same comprises: hot finish-rolling of a steel material containing C: 0.0005–0.020 wt %, and one or two of Nb: 0.003–0.040 wt %, and Ti: 0.005–0.060 wt % at a final temperature of 1,000–850° C., coiling at 750° C. or less, cold rolling, continuous annealing at 650° C.–850° C. for 20 seconds or less, and second cold-rolling at a rolling reduction rate of 20% or less, so that at least one of Nb and Ti is present in a solid solution state in an amount of 0.005 wt % or more, and the crystal grain size in the ferrite structure is in the range of 5 to 10 μm.

9 Claims, 1 Drawing Sheet

STEEL SHEET FOR DOUBLE WOUND PIPE AND METHOD OF PRODUCING THE PIPE

This application is a 371 of PCT/JP97/04289 filed Nov. 25, 1997.

TECHNICAL FIELD

The present invention relates to a steel sheet suitable for a double-rolled tube and a method for making the same, in which the surface of the steel sheet is plated with copper or a self-brazing metal, shaped into a pipe, and heated to a temperature higher than the melting point of the plating metal for a short duration to form the double-rolled tube.

BACKGROUND ART

Double-rolled tubes, having excellent appearances similar to those of copper tubes and excellent thermal characteristics, as well as high strength and toughness due to steel, have been used in the fields of connection tubes for various compressors and brake tubes of vehicles.

Double-rolled tubes are described in detail in, for example, "TETSU-TO-HAGANE", No. 1, p. 130 (1980). A typical method for making a double-rolled tube will now be described in brief. Using a cold-rolled steel sheet having a thickness of approximately 0.30 mm, both faces of the steel sheet are electroplated with copper. Next, the steel sheet is furled such that the rolling direction of the steel sheet is parallel to the central axis of the tube. The steel sheet is furled double so that the thickness of the tube is double that of the steel sheet. The tube is heated to a higher temperature than the melting point of copper for "self-brazing" which represents bonding of the steel sheet walls by means of filling the gap between the walls with molten copper. A double-rolled tube is prepared in such a manner. Next, cold reforming and sizing are performed to obtain a final product.

As described above, double-rolled tubes generally require reliability such as air-tightness in view of their usage.

Since steel sheets used for double-rolled tubes are ultra-thin cold-rolled steel sheet having a thickness of 0.35 mm or less and require significantly excellent formability, box-annealed low-carbon steel sheets generally have been used.

Since the box-annealed sheets are relatively soft materials and have excellent formability, these can be satisfactorily used as raw materials for double-rolled tubes. The sheet, however, requires several days for production, and thus has an inferior production efficiency. Another disadvantage is non-uniformity of the mechanical properties in the longitudinal and transverse directions of the coil. In addition, in order to reduce abrasion of the die for forming the tube and in order to improve shape fixability in the tubing process (furling process), softer materials having excellent formability, while maintaining high strength, are demanded.

Ultra-low-carbon steel sheets having a significantly decreased carbon content (0.020% or less) have been noted in the field of general cold-rolled steel sheets. The ultra-low-carbon steel sheets are suitable for a continuous annealing process having a high production efficiency and creating excellent uniformity of the mechanical properties. Further, the steel sheets are soft and have excellent formability. The use of a continuously-annealed soft ultra-low-carbon steel sheet is in prospect for solving the above-mentioned problems.

In the production process of the double-rolled tube, however, a cold working of approximately 7% to 8% strain is applied to the steel sheet after tubing by drawing. Further, the tube is subjected to heat treatment for self-brazing at a higher temperature than the melting point (1,083° C.) of copper, although for a short duration. Thus, coarsening of the micro-structure in the steel during the forming and annealing is anticipated. When a double-rolled tube is formed of an ultra-low-carbon steel sheet, presence of coarse grains severely affecting the strength and toughness of the double-rolled tube are often observed.

It is an object of the present invention to solve the above-mentioned problems involved in conventional technologies, and thus to provide a cold-rolled steel sheet suitable for producing double-rolled tubes having self-brazing characteristics, as well as significantly improved mechanical properties compared to conventional materials, and high production efficiency and uniformity of mechanical properties, and a method for making the same.

It is a particular object of the present invention to provide a cold-rolled steel sheet suitable for producing double-rolled tubes having the following characteristics, and a method for making the same:

1) Deterioration of its characteristics, particularly strength and toughness due to coarse grains does not occur during the heat treatment for self-brazing;
2) The steel sheet has a low deformation resistance in the tube production process to minimize abrasion of a die and thus to prolong its life;
3) The steel sheet is soft during the production of the tube and has excellent shape fixability;
4) The final tube has sufficiently high strength, ductility, and toughness; and
5) The steel sheet is an ultra thin sheet with a thickness of 0.35 mm, has excellent uniformity of mechanical properties in the longitudinal and transverse directions of the steel sheet (steel strip), and has no variation in the shape.

The present inventors have discovered that containing a given amount or more of nonprecipitated Nb or Ti is effective for preventing the growth of grains contrary to conventional knowledge that control of the precipitates is effective, as a result of intensive experimentation and study for solving the above-mentioned problems.

Further, by controlling the annealing condition within an adequate range, as well as limiting steel components, and hot-rolling conditions, such as the final temperature at finish-rolling and the coiling temperature, the present inventors have discovered that the given amount or more of nonprecipitated Nb or Ti is secured in a nonprecipitated state, that is, a solid solution state, that the crystal grain size is controllable within an optimum range, and that mechanical properties are stabilized after heat treatment in the tube production process, and the present inventors have completed the present invention.

DISCLOSURE OF INVENTION

1) The present invention relates to a steel sheet for double-rolled tubes having excellent formability, and excellent strength and toughness after forming and heat treatment of a tube comprising:

C: 0.0005–0.020 wt %; and further comprising one or two of

Nb: 0.003–0.040 wt %, and

Ti: 0.005–0.060 wt %;

at least one of Nb and Ti being present in a solid solution state in an amount of 0.005 wt % or more, the grain size in the ferrite structure being in the range of 5 to 10 $\mu$m (Claim 1).

2) Further, the present invention relates to a steel sheet for double-rolled tubes having excellent formability, and excellent strength and toughness after forming and heat treatment of a tube comprising:

C: 0.0005–0.020 wt %,

S: 0.02 wt % or less, and

N: 0.0050 wt % or less; and further comprising one or two of

Nb: 0.003–0.040 wt %, and

Ti: 0.005–0.060 wt %;

each of the excessive Nb and Ti contents, calculated based on the assumption that TiN, TiS, TiC and NbC are formed as much as possible in that order, being less than 0.005 wt %, at least one of Nb and Ti being present in a solid solution state in an amount of 0.005 wt % or more, the crystal grain size in the ferrite structure being in the range of 5 to 10 $\mu$m (Claim 2).

3) Also, the present invention relates to a steel sheet for double-rolled tubes, described above in 1) or 2), comprising:

C: 0.0005–0.020 wt %,

Si: 0.10 wt % or less,

Mn: 0.1–1.5 wt %,

P: 0.02 wt % or less,

S: 0.02 wt % or less,

Al: 0.100 wt % or less, and

N: 0.0050 wt % or less; and further comprising one or two of

Nb: 0.003–0.040 wt %, and

Ti: 0.005–0.060 wt %; and the balance being Fe and incidental impurities (Claim 3).

4) Further, the present invention relates to a steel sheet for double-rolled tubes, described above in 1) or 2), comprising:

C: 0.0005–0.020 wt %,

Si: 0.10 wt % or less,

Mn: 0.1–1.5 wt %,

P: 0.02 wt % or less,

S: 0.02 wt % or less,

Al: 0.100 wt % or less, and

N: 0.0050 wt % or less; and further comprising one or two of

Nb: 0.003–0.040 wt %, and

Ti: 0.005–0.060 wt %; and at least one selected from the group consisting of

B: 0.0005–0.0020 wt %,

Cu: 0.5 wt % or less,

Ni: 0.5 wt % or less,

Cr: 0.5 wt % or less, and

Mo: 0.5 wt % or less; and the balance being Fe and incidental impurities (Claim 4).

5) Also, the present invention relates to a method for making a steel sheet for double-rolled tubes having excellent formability, and excellent strength and toughness after forming and annealing a tube comprising:

hot finish rolling of a steel material containing

C: 0.0005–0.020 wt %, and further containing one or two of

Nb: 0.003–0.040 wt %, and

Ti: 0.005–0.060 wt % at a final temperature of 1,000–850° C.; coiling at 750° C. or less; cold rolling; continuous annealing at 650–850° C. for 20 seconds or less; and second cold-rolling at a rolling reduction rate of 20% or less (Claim 5).

6) Further, the present invention relates to a method for making a steel sheet for double-rolled tubes, having excellent formability, and excellent strength and toughness after forming and annealing a tube, comprising:

hot finish-rolling of a steel material at a final temperature of 1,000–850° C., the steel material comprising C: 0.0005–0.020 wt %, S: 0.02 wt % or less, and N: 0.0050 wt % or less, and further comprising one or two of Nb: 0.003–0.040 wt %, and Ti: 0.005–0.060 wt %, each of the excessive Nb and Ti contents, calculated based on the assumption that TiN, TiS, TiC and NbC are formed as much as possible in that order, being less than 0.005 wt %; coiling at 750° C. or less; cold-rolling; continuous annealing at 650° C.–850° C. for 20 seconds or less; and second cold-rolling at a rolling reduction rate of 20% or less (Claim 6).

7) Further, the present invention relates to a method for making a steel sheet for double-rolled tubes, described in the above 5) or 6), the steel sheet comprising:

C: 0.0005–0.020 wt %,

Si: 0.10 wt % or less,

Mn: 0.1–1.5 wt %,

P: 0.02 wt % or less,

S: 0.02 wt % or less,

Al: 0.100 wt % or less, and

N: 0.0050 wt % or less; and further comprising one or two of

Nb: 0.003–0.040 wt %, and

Ti: 0.005–0.060 wt %, and the balance being Fe and incidental impurities (Claim 7).

8) Also, the present invention relates to a method for making a steel sheet for double-rolled tubes, described in the above 5) or 6), the steel sheet comprising:

C: 0.0005–0.020 wt %,

Si: 0.10 wt % or less,

Mn: 0.1–1.5 wt %,

P: 0.02 wt % or less,

S: 0.02 wt % or less,

Al: 0.100 wt % or less, and

N: 0.0050 wt % or less; and further comprising one or two of

Nb: 0.003–0.040 wt %, and

Ti: 0.005–0.060 wt %; and at least one selected from the group consisting of

B: 0.0005–0.0020 wt %,

Cu: 0.5 wt % or less,

Ni: 0.5 wt % or less,

Cr: 0.5 wt % or less, and

Mo: 0.5 wt % or less; and the balance being Fe and incidental impurities (Claim 8).

BEST MODE FOR CARRYING OUT THE INVENTION

Figure 1:
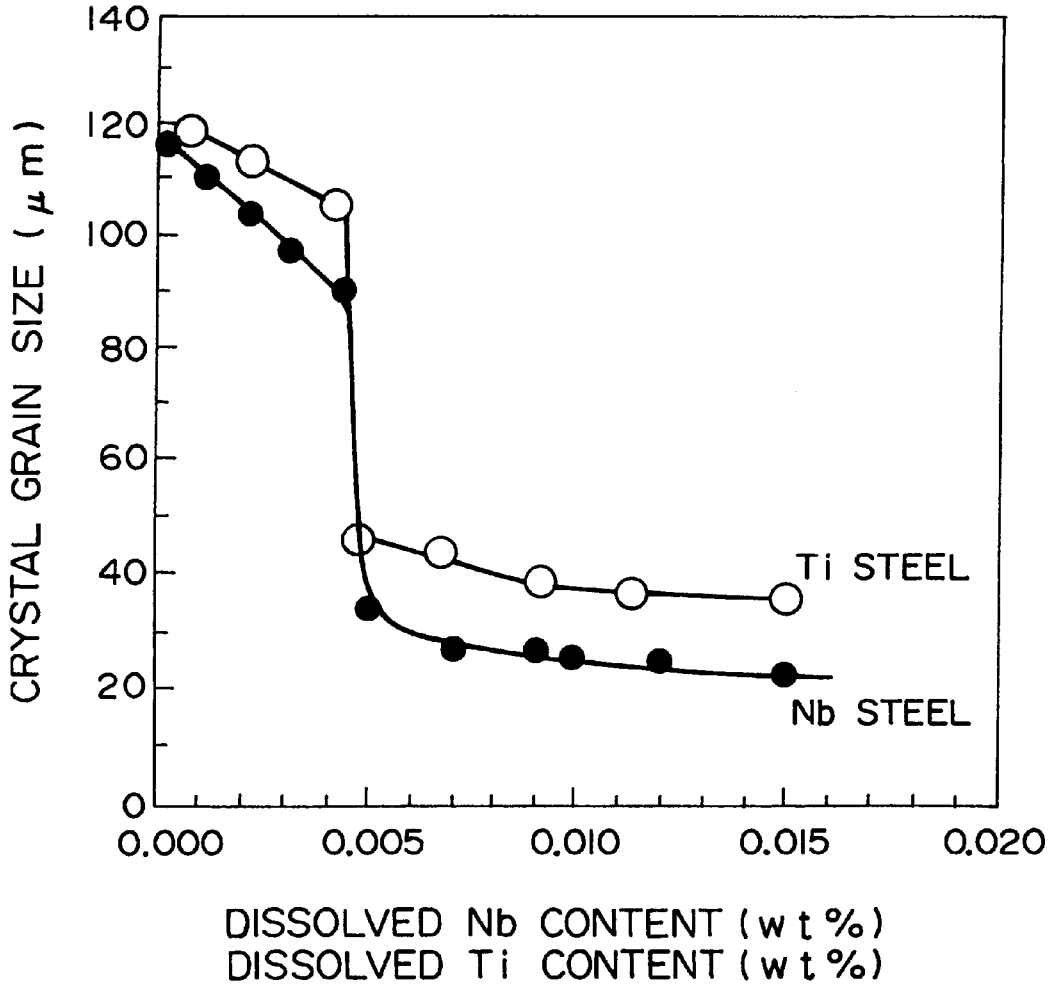
FIG. 1 is a graph illustrating the correlation between the Nb or Ti content in a solid solution state and the ferrite grain size.

The preferred embodiment of the present invention will now be described.

(1) Components in the Steel

C: 0.0005–0.020 wt %

An extremely reduced carbon content contributes to improved formability (decreased deformation stress and improved shape fixability) in the tube production process. At a carbon content of less than 0.0005 wt %, however, coarsening of grains is prominent, hence desirable strength and toughness are not achieved. Further, the possibility of the formation of rough surfaces like the so-called "orange peel phenomenon" will increases. On the other hand, a carbon content of more than 0.02 wt % causes a significant deterioration of ductility and shape fixability of the steel sheet, and thus deterioration of workability accompanied by thinning of the steel sheet is further prominent. Also, an excessive carbon content leads to decreases in the cold-rolling performance. Thus, the carbon content is set to a range of 0.0005 to 0.020 wt %. It is preferable that the range be 0.0010 to 0.015 wt % when requiring greater stability of the mechanical properties and excellent ductility.

Si: 0.10 wt % or less

Addition of a large amount of Si causes decreased surface treatment characteristics and corrosion resistance, significantly increases the strength of the steel as a solid solution strengthening, and thus ail increases the deformation resistance during the forming process. Thus, the upper limit is set to 0.10 wt %. It is preferable that the content be limited to 0.02 wt % or less when requiring particularly excellent corrosion resistance.

Mn: 0.1–1.5 wt %

Manganese is an element effectively preventing hot cracking caused by sulphur. In particular, it is preferable that manganese be added to non-titanium steel in response to the sulphur content. Since manganese contributes to making grains finer and particularly to the suppression of coarsening of grains when the steel is maintained at a high temperature, the addition of manganese is preferred.

At least 0.1 wt % of manganese must be added in order to achieve these advantages. Since an excessive addition, however, leads to deterioration of corrosion resistance and cold rolling characteristics because of hardening of the steel sheet, the upper limit is set to 1.5 wt %. It is preferable that manganese be added within a range of 0.60 wt % or less when requiring more excellent corrosion resistance and formability.

P: 0.02 wt % or less

Phosphorus hardens the steel and causes deterioration of flange workability and shape fixability. Further, it is a harmful element which causes deterioration of corrosion resistance, hence the upper limit is set to 0.02 wt %. It is preferable that it be added in an amount of 0.01 wt % or less when these characteristics are particularly important.

S: 0.02 wt % or less

Since sulphur is present as inclusions in the steel, and is an element which causes the ductility of the steel to decrease and causes the deterioration of corrosion resistance, the upper limit of the sulphur content is set to 0.02 wt %. It is preferable that it be added in amount of 0.01 wt % or less when particularly excellent workability is demanded.

Al: 0.100 wt % or less

Aluminum is an element which is effective for deoxidation in steel. Since an excessive content, however, causes deterioration of surface characteristics, the upper limit of the aluminum content is set to 0.100 wt %. It is preferable that aluminum be added in an amount in the range of 0.008 to 0.060 wt % in view of stability of the mechanical properties.

N: 0.0050 wt % or less.

Nitrogen promotes occurrences of internal defects in the steel sheet as well as slab cracking in a continuous casting process as the content increases. Since nitrogen causes excessive hardening of the steel, the upper limit is set to 0.0050 wt %. It is preferable that the nitrogen content be 0.0030 wt % or less in view of stability of the mechanical properties and improvement in yield on account of the entire production process.

Nb: 0.003–0.040 wt %

Niobium is an element which is effective for making the micro-structure of the steel sheet finer, and such an effect is held after heat treatment after tube production. Such a finer micro-structure in the steel sheet causes significant improvement in secondary formability in the use as a tube, such as bending and stretching of the tube, and improvement in impact resistance. Such advantages due to niobium are noticeable in a content of 0.003 wt % or more; however, the addition of more than 0.040 wt % will cause hardening of the steel and slab cracking, as well as deteriorated ductility during hot-rolling and cold-rolling. The niobium content is therefore set to a range of 0.003 to 0.40 wt %. It is more preferable if the content be 0.020 wt % or less in view of mechanical properties.

Ti: 0.005–0.060 wt %

Titanium is also effective for making the micro-structure finer as with niobium. Although it is added in an amount of 0.005 wt % or more to achieve such an effect, the addition of more than 0.060 wt % causes an increase in the occurrence of surface defects. The titanium content is therefore set to a range of 0.005 to 0.060 wt %. It is more preferable that the content be 0.015 wt % or less in view of mechanical properties. Niobium and titanium may be added solely or in combination, since effects due to individual elements are not canceled by each other.

Nb and Ti in Solid Solution State

Niobium and titanium in solid solution state are a significantly important feature in the present invention. Although the detailed mechanism has not been clarified, coarsening of the micro-structure after forming-heat-treatment of the double-rolled tube can be remarkably suppressed, as shown in FIG. 1, when at least one of niobium and titanium in solid solution state is present in an amount of 0.005 wt % or more. The steel materials used in the experiment in FIG. 1 have the following compositions; 0.0025 C-0.02 Si-0.5 Mn-0.01 P-0.010 S-0.040 Al-0.0020 N-varied Nb or Ti, wherein the two levels of Nb contents, that is, 0.018% and 0.015%, and two levels of Ti contents, that is, 0.040 and 0.060% are employed. Conditions for hot-rolling and heat-treatment are as follows: the final temperature of hot-rolling is in the range of 950–870° C., the coiling temperature is in the range of 720–540° C., heat-treatment is performed at 750° C. for 20 sec, and second cold-rolling of 2% is performed after the heat-treatment. As a result, the dissolved niobium content can be varied within the range of 0 to 0.015%.

Among niobium and titanium, at least one element must be present, because the above-mentioned advantage is not achieved even if these two elements are present in a total amount of 0.005 wt % or more. If each of these elements is present in a amount of 0.005 wt % or more, individual effects due to these elements are not canceled by each other. Accordingly, it is important that at least one of niobium and titanium is present in an amount of 0.005 wt % or more in a solid solution state.

The Nb or Ti content in a solid solution state is defined as the subtraction of the precipitated Nb or Ti content, which is determined by electrolytic analysis, from the total Nb or Ti content in the steel. The electrolytic analysis is defined as an analytical method by means of constant potential electrolysis in a non-aqueous electrolyte, wherein a sample is electrolyzed in a 10% acetylacetone −1% tetramethylammonium chloride electrolyte, the residue is collected on a 0.2-μm nuclear pore filter, and the relevant elements are determined by an absorptiometric method.

Excessive Ti and Nb

As described above, although titanium and niobium are essential elements in the present invention, the addition of an excessive amount of each element causes the following disadvantages.

In general cold-rolled steel sheets, titanium and niobium are considered as elements which are desirable for improving formability, such as softening, and for improving the r value and ductility. In ultra-thin steel sheets in the present invention, however, an extremely high cold-rolling reduction rate is required in the production step (at least 70% and generally 80% or more in the current highest technology for thin hot-rolling), hence a large load occurs during cold rolling. The addition of an excessive amount of Nb or Ti therefore causes the deformation resistance to increase significantly during rolling and causes deterioration of surface characteristics. Changes in mechanical properties, such as strength, an r value, and ductility, between the working directions, that is, anisotropy are also increased. The addition of an excessive amount of Ti or Nb must be avoided to prevent the occurrence of the above-mentioned disadvantages. Further, it is preferable that the Ti and Nb contents be minimized within necessity in view of the material costs.

Based on the grounds described above, the present inventors studied the upper limits of the Ti and Nb contents by the precipitation process, and discovered the following upper limits of the contents. Each of the excessive Nb and Ti contents, which are calculated using the contents in the steel based on the assumption that TiN, TiS, TiC and NbC are formed as much as possible in that order, must be less than 0.005 wt %.

Specifically, the excessive Ti content (hereinafter referred to as $Ti_{ex}$) means the residual Ti content by weight percent after the formation of TiN, TiS and TiC, and is stoichiometrically calculated by the following equation:

$$Ti_{ex}=Ti-(48/14).N-(48/32).S-(48/12).C$$

The excessive Nb content (hereinafter referred to as $Nb_{ex}$) is calculated as follows:

1) When titanium is not added, $Nb_{ex}$ is calculated by the following equation in consideration of only NbC, because TiN, TiS or TiC is not formed:

$$Nb_{ex}=Nb-(93/12).C$$

2) When titanium is added and when $Ti_{ex}\geqq 0$, $Nb_{ex}$ is calculated by the following equation, because residual carbon forming NbC is not present:

$$Nb_{ex}=Nb$$

3) When titanium is added and when $Ti_{ex}\leqq 0$, first, the Ti content as the formed TiN and TiS (hereinafter referred to as TiNS) is calculated by the following equation:

$$Ti_{NS}=Ti-(48/14).N-(48/32).S,$$

and then $Nb_{ex}$ is calculated by either of the following equations in response to the $Ti_{NS}$ content:

3a) when $Ti_{NS}\leqq 0$, $Nb_{ex}=Nb-(93/12).C$ (the same as the above-mentioned 1)), because all the carbon is used for the formation of NbC, or 3b) when $Ti_{NS}>0$, $Nb_{ex}=Nb-(93/12).(C-(12/48).Ti_{NS})$, because after TiC is formed in response to the $Ti_{NS}$, the residual carbon is used for the formation of NbC.

By providing such upper limits of the Ti and Nb contents, it is difficult to maintain the contents of solid solutions. The present invention is, however, characterized in that desirable contents of dissolved Ti and Nb are achieved, the problems in the steel sheet production are solved, and compatibility between the mechanical properties and a given strength and a given toughness after forming a double-rolled tube is achieved.

The steel sheet may contain at least one component selected from a group or groups consisting of B: 0.0005–0.0020 wt % (group A), Cu: 0.5 wt % or less, Ni: 0.5 wt % or less, Cr: 0.5 wt % or less, and Mo: 0.5 wt % or less (group B, hereinafter the same).

B: 0.0005–0.0020 wt %

B is an element which is effective for maintaining strength because of a finer structure after making the tube. Such an advantage is recognized by the addition of 0.0005 wt % or more, whereas the addition of more than 0.0020 wt % causes undesirable increase in planar anisotropy of the steel sheet. Accordingly, the B content is added within the range of 0.0005 to 0.0020 wt %, and preferably 0.0005 to 0.0010 wt %.

Cu: 0.5 wt % or less, Ni: 0.5 wt % or less,

Cr: 0.5 wt % or less and Mo: 0.5 wt % or less

These elements, which enhance the strength of the steel sheet, and particularly, the strength after heat treatment in the brazing of the tube, are added, if necessary. When each of these elements is, however, added in an amount of more than 0.5 wt %, cold-rolling characteristics deteriorate, hence they are added within 0.5 wt % or less.

The group A element including B, and the group B elements including Cu, Ni, Cr and Mo, both being optional components, may be added solely or in combination, which consists of at least two elements from the same group or different groups.

(2) Regarding Crystal Structure etc.:

The grain size of the ferrite is set to 5 to 10 μm. The steel containing the crystals having a size of less than 5 μm is hardened, hence unsatisfactory phenomena, such as a poor shape after tubing and severe abrasion of tools, significantly occur. On the other hand, when the grain size is more than 10 μm, a uniformly fine texture is barely maintained after forming-annealing, hence the strength and toughness of the product in use decrease. Accordingly, the crystal grain size in the steel sheet is controlled to within 5 to 10 μm.

It is desirable that the hardness (temper grade) be T1–T3. A temper grade of more than T3 evidently causes deterioration of formability and causes significant decrease in the life of the tools. It is desirable that the strength of the raw material be as low as possible if the strength after forming and heat treatment of the tube is sufficiently high.

Toughness, as well as the strength, after forming and heat treatment of the tube of the steel sheet for double-rolled tubes is also an important factor. The toughness is evaluated by tensile testing or high-speed tensile testing of a pipe with a notch.

(3) Manufacturing Conditions etc.:

Hot Finish-Rolling:

Since uniformity of the micro structure after annealing decreases when the final rolling temperature in the hot finish-rolling is lower than 850° C. and such nonuniformity is succeeded after annealing after cold rolling, a remarkable fluctuation of the mechanical properties is recognized, resulting in decreased reliability of mechanical properties. On the other hand, surface flaws due to scales prominently occur at a temperature of higher than 1,000° C. Accordingly, it is desirable that the final rolling temperature of the hot finish-rolling be within the range of 1,000–850° C. It is preferable that the final temperature be within the range of 950–850° C. in view of hot-rolling characteristics.

To decrease the opportunity of precipitation of Ti or Nb after hot finish-rolling, it is preferable that the steel sheet be quenched at a quenching rate of 30° C./sec. or more within a second after the finish rolling.

In finish-rolling the sheet bar after hot rough-rolling, adaption of continuous rolling (endless rolling) including joining the sheet bars at the inlet side of a finish-rolling mill is preferable, because travelling of the front and rear ends of the steel sheet is stabilized and thus rapid cooling of the steel sheet immediately after finish-rolling can be achieved over the entire length.

Coiling after Hot-Rolling:

It is difficult to maintain Nb and Ti in solid solution state in the steel if the coiling temperature after hot rolling is higher than 750° C. As a result, suppression of coarsening of crystal grains due to dissolved Nb and Ti cannot be sufficiently achieved. In this case, it is difficult to achieve uniform mechanical properties in the longitudinal direction. Accordingly, the coiling temperature after hot-rolling is set to 750° C. or less, and preferably, 650° C. or less.

Conditions of the following pickling and cold-rolling are not fixed and are determined according to a general method for making an ultra-thin steel sheet.

Annealing after Cold-Rolling:

If the annealing temperature is lower than 650° C., most of the structure is. occupied by a non-recrystallized structure, and thus the steel sheet is not softened. A target, that the load is reduced in the tube production process, is therefore not achieved. Although annealing at 650° C. or more does not form a perfect recrystallized structure, softening which is sufficient to the usage in the present invention is achieved. At an annealing temperature at 750° C. or more, most of the structure is occupied by a recrystallized structure, and extremely superior workability is achieved. When it is annealed at a temperature higher than 850° C. as in general ultra-low carbon cold-rolled steel sheets for working, the micro structure in the steel is coarsened and becomes non-uniform, the precipitation of Ti and Nb is promoted during the annealing, and thus a uniform and fine texture is not formed after tubing-heat-treatment.

Accordingly, the annealing temperature is within the range of, preferably, 650–850° C., and particularly, 700–800° C. in view of stability of the mechanical properties. It is more preferable that the temperature be 750° C. or less in economical view, in addition to stability of the mechanical properties.

The soaking time during annealing is also an important factor. Conventional annealing is generally performed for at least 30 seconds in order to form a stable recrystallization texture. Such annealing, however, does not form dissolved Ti or Nb, which is essential for the present invention, because of the precipitation of Ti and Nb during the annealing. The dissolved Ti or Nb can be formed by controlling the annealing temperature to 850° C. or less and the soaking time to 20 seconds or less, as described above. It has been considered that the annealing of an ultra-low carbon steel sheet for such a short time has an unsatisfactory r value and ductility for the use with deep drawing; however, such annealing for a short time can be applied to the present invention without any problems.

Second Cold-Rolling after Annealing

Second cold-rolling performed after annealing controls surface roughness and decreases the thickness of the sheet. It is preferable that the reduction rate of the second cold-rolling be 1.0% or more. If the second cold rolling is performed at a reduction rate of more than 20%, tube forming characteristics deteriorate because of increased yield stress among mechanical properties. Accordingly, the reduction rate of the second cold rolling after annealing is set to 20% or less. It is preferable that the reduction rate be within the range of 1.0 to 10%.

A steel sheet in accordance with the present invention is manufactured by following the above-mentioned steps. The final thickness of the steel sheet is not limited, and the present invention is more effectively applied to a final thickness of 0.35 mm or less.

Surface Treatment:

A metal having a self-brazing property, such as copper, is plated onto the above-mentioned steel sheet which is brazed by heat treatment after the tube production. Although no additional surface treatment is basically required, chemical or electrochemical treatment may be added to enhance the metal plating effect.

EXAMPLE 1

A series of steels containing the components shown in Table 1 and the balance being Fe were melted in a converter, and each of the resulting steel slabs was hot rolled under the condition shown in Table 2 (rapid cooling at a rate of 50° C./sec. within 0.5 seconds after finishing the hot-rolling. In the hot-rolling, a slab having a thickness of 260 mm was rough-rolled with seven passes to form a sheet bar having a thickness of 30 mm, and a hot-rolled mother sheet coil was made from the sheet bar with a 7-stand tandem rolling mill. The mother sheet coil was pickled, cold-rolled with a tandem rolling mill, annealed and subjected to second cold-rolling.

Copper with a thickness of 30 $\mu$m was electroplated onto the steel sheet, and a 3.45 mm$\phi$ double-rolled tube was formed with the plated sheet by a conventional process, subjected to 5% drawing, and heat-treated at 1,120° C. for 20 seconds to braze the copper plating layer.

The resulting steel sheet and the self-brazed double-rolled tube were used for the following tests:

1) The grain size of the ferrite crystals at the transverse cross-section;
2) Tensile strength by a static tensile test;
3) The reduction of area by a low-temperature tensile test (at −40° C.) for evaluating toughness, which is equivalent to impact tensile strength at a high speed; and
4) Bend test (180° bending).

In all these tests, general methods for determining mechanical properties were used except that the double-rolled tube was used without further working.

The results are shown in Table 3. In each of the examples in accordance with the present invention in which the dissolved Nb and Ti contents lie within adequate ranges, the crystal grains are not coarsened after high temperature heating, sufficient strength and ductility, excellent low-temperature toughness (drawing due to the tensile test), excellent bend workability, and excellent shape fixability are achieved.

Each of the steels 12, 13 and 14 is hard, a satisfactory shape is not achieved in the final cold-rolled steel sheet, with inferior bending characteristics.

EXAMPLE 2

A series of slabs having a composition shown in No. 1 of Table 1 was hot-rolled, pickled, cold-rolled, and subjected to continuous annealing and second cold-rolling under the conditions shown in Table 4 (the cooling condition was the same as in Example 1) to form ultra-thin cold-rolled steel sheets. A conventional box-annealed low-carbon aluminum-killed steel was used for comparison.

Copper was plated onto the surface of each of these steel sheets as in Example 1 to form a double-rolled tube.

Abrasion of the tools (life of the tools) used in the tubing was also evaluated in addition to the tests in Example 1. In the evaluation of the life of the tools, the relative ratio, in which the life of the sample for comparison (box-annealed low-carbon aluminum-killed steel) was set to 1, was used.

The experimental results are also shown in Table 4. Table 4 demonstrates that each of the soft steel sheets in accordance with the present invention has a life of the tools which is approximately 1.5 times that in the sample for comparison. In the samples containing dissolved Nb and Ti within the range of the present invention, coarsening of the microstructure is effectively suppressed after tubing.

INDUSTRIAL APPLICABILITY

As described above, since the steel sheet in accordance with the present invention is soft, it has low deformation resistance, and reduces abrasion of the tools and thus prolongs their life. In the present invention, in addition to excellent formability, a double-rolled tube having excellent strength and toughness is produced due to reduced coarsening of the ferrite grains.

Further, a continuous annealing process is applied in the present invention, hence a high production efficiency and uniformity of mechanical properties can be achieved.

Accordingly, a high-quality double-rolled tube with high airtightness can be effectively and economically produced in the present invention.

TABLE 1

(wt %)

| No. | C | Si | Mn | P | S | Al | N | Nb | Ti | Others | Excessive Nb | Excessive Ti | Remarks |
|---|---|---|---|---|---|---|---|---|---|---|---|---|---|
| 1 | 0.0020 | 0.01 | 0.55 | 0.010 | 0.005 | 0.055 | 0.0015 | 0.017 | — | | 0.0015 | — | Within this invention |
| 2 | 0.0040 | 0.01 | 0.15 | 0.005 | 0.005 | 0.040 | 0.0015 | 0.009 | — | | −0.022 | — | Within this invention |
| 3 | 0.0120 | 0.01 | 0.20 | 0.006 | 0.003 | 0.065 | 0.0018 | 0.015 | — | Cu: 0.05 | −0.078 | — | Within this invention |
| 4 | 0.0080 | 0.01 | 0.10 | 0.01 | 0.007 | 0.045 | 0.0025 | 0.018 | — | Cr: 0.06 | −0.044 | — | Within this invention |
| 5 | 0.0020 | 0.01 | 0.15 | 0.007 | 0.008 | 0.065 | 0.0021 | — | 0.015 | Ni: 0.06, Mo: 0.02 | — | −0.12 | Within this invention |
| 6 | 0.0035 | 0.01 | 0.35 | 0.006 | 0.005 | 0.040 | 0.0040 | — | — | | — | — | For comparison |
| 7 | 0.0600 | 0.01 | 0.15 | 0.006 | 0.002 | 0.040 | 0.0010 | — | — | | — | — | For comparison |
| 8 | 0.0410 | 0.01 | 2.00 | 0.006 | 0.002 | 0.040 | 0.0010 | — | — | | — | — | For comparison |
| 9 | 0.0020 | 0.01 | 0.57 | 0.011 | 0.006 | 0.053 | 0.0012 | 0.017 | — | B: 0.0009 | 0.0015 | — | Within this invention |
| 10 | 0.0020 | 0.02 | 0.17 | 0.0010 | 0.008 | 0.067 | 0.0021 | — | 0.015 | | — | −0.12 | Within this invention |
| 11 | 0.0020 | 0.03 | 0.22 | 0.0009 | 0.006 | 0.052 | 0.0021 | 0.017 | 0.015 | | 0.0015 | −0.009 | Within this invention |
| 12 | 0.0020 | 0.01 | 0.20 | 0.0070 | 0.007 | 0.040 | 0.0020 | 0.025 | 0.035 | | 0.025 | 0.009 | Within this invention |
| 13 | 0.0020 | 0.02 | 0.40 | 0.0050 | 0.005 | 0.040 | 0.0022 | 0.026 | — | | 0.011 | — | For comparison |
| 14 | 0.0022 | 0.01 | 0.22 | 0.0030 | 0.006 | 0.050 | 0.0021 | — | 0.039 | | — | 0.014 | For comparison |

TABLE 2

| | Hot finish rolling | | | Cold rolling | | Continuous annealing | | | 2nd cold |
|---|---|---|---|---|---|---|---|---|---|
| Steel | Final Temperature (° C.) | Final thickness (mm) | Coiling Temperature (° C.) | Rolling reduction (%) | Final thickness (mm) | Method | Temperature (° C.) | Soaking time (sec) | rolling reduction (%) |
| 1~6 9~14 | 890 | 2.1 | 650 | 85 | 0.315 | Continuous | 760 | 15 | 2 |
| 7 | 860 | 2.1 | 650 | 85 | 0.315 | Continuous | 680 | 30 | 2 |
| 8 | 860 | 2.1 | 600 | 85 | 0.315 | Box | 650 | 55 (hr) | 2 |

TABLE 3

| Steel | Dissolved Nb (wt %) | Dissolved Ti (wt %) | Crystal grain size (μm) Before heat treatment | Crystal grain size (μm) After heat treatment | Tensile strength (kgf/mm²) Before heat treatment | Tensile strength (kgf/mm²) After heat treatment | Reduction of area at low temperature tensile testing (%) | Cracks after bend test | Remarks |
|---|---|---|---|---|---|---|---|---|---|
| 1 | 0.009 | | 8.1 | 25 | 37 | 35 | 85 | Non | Within this invention |
| 2 | 0.006 | | 8.5 | 26 | 38 | 36 | 80 | Non | Within this invention |
| 3 | 0.008 | | 7.9 | 24 | 39 | 39 | 82 | Non | Within this invention |
| 4 | 0.01 | | 7.9 | 23 | 38 | 37 | 82 | Non | Within this invention |
| 5 | | 0.007 | 8.0 | 21 | 38 | 37 | 85 | Non | Within this invention |
| 6 | | | 8.3 | 90 | 36 | 25 | 85 | Cracks & rough surface | For comparison |
| 7 | | | 8.2 | 25 | 41 | 31 | 60 | Non | For comparison |
| 8 | | | 8.0 | 27 | 36 | 30 | 58 | Non | For comparison |
| 9 | 0.009 | | 7.9 | 22 | 38 | 37 | 84 | Non | Within this invention |
| 10 | | 0.006 | 8.4 | 26 | 35 | 34 | 88 | Non | Within this invention |
| 11 | 0.008 | 0.006 | 7.8 | 22 | 36 | 35 | 89 | Non | Within this invention |
| 12 | 0.022 | 0.007 | 7.6 | 24 | 37 | 36 | 70 | Fine cracks, surface flaws, and large rolling load (deteriorated shape) | For comparison |
| 13 | 0.021 | | 8.1 | 25 | 35 | 34 | 72 | Fine cracks, surface flaws, and large rolling load (deteriorated shape) | For comparison |
| 14 | | 0.009 | 8.2 | 28 | 34 | 31 | 70 | Fine cracks, surface flaws, and large rolling load (deteriorated shape) | For comparison |

TABLE 4

| Steel | Hot finish rolling Final Temp. (° C.) | Hot finish rolling Final thickness (mm) | Hot finish rolling Coiling Temp (° C.) | Cold rolling Rolling reduction (%) | Cold rolling Final thickness (mm) | Continuous annealing Method | Continuous annealing Temp. (° C.) | Continuous annealing Soaking time (sec) | 2nd cold rolling reduction (%) | Dissolved Nb (wt %) | Dissolved Ti (wt %) | Crystal grain size (μm) Before heat treatment | Crystal grain size (μm) Before heat treatment | Life of tools | Remarks |
|---|---|---|---|---|---|---|---|---|---|---|---|---|---|---|---|
| 1 | 890 | 2.2 | 650 | 85 | 0.33 | Continuous | 760 | 15 | 2.0 | 0.010 | 0 | 8.5 | 27 | 1.5 | Within this inveniton |
| 5 | 890 | 2.1 | 650 | 84 | 0.34 | Continuous | 765 | 15 | 2.0 | 0.000 | 0.012 | 9.2 | 26 | 1.5 | Within this inveniton |
| 1 | 880 | 2.2 | 780 | 85 | 0.33 | Continuous | 760 | 18 | 1.5 | 0.001 | 0 | 9.2 | 45 | 1.6 | For comparison |
| 1 | 800 | 2.1 | 650 | 84 | 0.34 | Continuous | 860 | 18 | 1.5 | 0.001 | 0 | 10.5 | 50 | 1.6 | For comparison |
| 1 | 880 | 2.7 | 600 | 84 | 0.43 | Continuous | 760 | 15 | 25.0 | 0.009 | 0 | 8.7 | 45 | 1.2 | For comparison |
| 6 | 860 | 2.1 | 620 | 84 | 0.34 | Continuous | 700 | 18 | 1.5 | 0.000 | 0 | 10.6 | 100 | 1.6 | For comparison |
| 7 | 840 | 2.2 | 650 | 85 | 0.33 | Continuous | 700 | 18 | 1.5 | 0.000 | 0 | 7.2 | 21 | 0.75 | For comparison |
| 8 | 840 | 2.2 | 600 | 85 | 0.33 | Box | 680 | — | 1.8 | 0.000 | 0 | 8.5 | 23 | 1.0 | For comparison |
| 1 | 840 | 2.1 | 700 | 85 | 0.32 | Continuous | 720 | 45 | 2.0 | 0.000 | 0 | 8.7 | 95 | 1.6 | For comparison |

What is claimed is:

1. A steel sheet for double-rolled tubes having excellent formability, and excellent strength and toughness after forming and heat treatment of a tube comprising:

C: 0.0005–0.020 wt %; and further comprising one or two of

Nb: 0.003–0.040 wt %, and

Ti: 0.005–0.060 wt %;

at least one of Nb and Ti being present in a solid solution state in an amount of 0.005 wt % or more, the crystal grain size in the ferrite structure being in the range of 5 to 10 μm.

2. A steel sheet for double-rolled tubes having excellent formability, and excellent strength and toughness after forming and heat treatment of a tube comprising:

C: 0.0005–0.020 wt %,

S: 0.02 wt % or less, and

N: 0.0050 wt % or less; and further comprising one or two of

Nb: 0.003–0.040 wt %, and

Ti: 0.005–0.060 wt %;

each of the excessive Nb and Ti contents, calculated based on the assumption that TiN, TiS, TiC and NbC are formed as much as possible in that order, being less than 0.005 wt %, at least one of Nb and Ti being present in solid solution state in an amount of 0.005 wt % or more, the crystal grain size in the ferrite structure being in the range of 5 to 10 $\mu$m.

3. A steel sheet for double-rolled tubes, according to claim 1, comprising:

C: 0.0005–0.020 wt %,

Si: 0.10 wt % or less,

Mn: 0.1–1.5 wt %,

P: 0.02 wt % or less,

S: 0.02 wt % or less,

Al: 0.100 wt % or less, and

N: 0.0050 wt % or less; and further comprising one or two of

Nb: 0.003–0.040 wt %, and

Ti: 0.005–0.060 wt %; and the balance being Fe and incidental impurities.

4. A steel sheet for double-rolled tubes, according to claim 1, comprising:

C: 0.0005–0.020 wt %,

Si: 0.10 wt % or less,

Mn: 0.1–1.5 wt %,

P: 0.02 wt % or less,

S: 0.02 wt % or less,

Al: 0.100 wt % or less, and

N: 0.0050 wt % or less; and further comprising one or two of

Nb: 0.003–0.040 wt %, and

Ti: 0.005–0.060 wt %; and at least one selected from the group consisting of

B: 0.0005–0.0020 wt %,

Cu: 0.5 wt % or less,

Ni: 0.5 wt % or less,

Cr: 0.5 wt % or less, and

Mo: 0.5 wt % or less; and the balance being Fe and incidental impurities.

5. A method for making a steel sheet for double-rolled tubes, having excellent formability, and excellent strength and toughness after forming and heat treatment of a tube, comprising:

hot finish-rolling of a steel material at a final temperature of 1,000–850° C., the steel material comprising C: 0.0005–0.020 wt %, S: 0.02 wt % or less, and N: 0.0050 wt % or less, and further comprising one or two of Nb: 0.003–0.040 wt %, and Ti: 0.005–0.060 wt %, each of the excessive Nb and Ti contents, calculated based on the assumption that TiN, TiS, TiC and NbC are formed as much as possible in that order, being less than 0.005 wt %; coiling at 750° C. or less; cold-rolling; continuous annealing at 650° C.–850° C. for 20 seconds or less; and second cold-rolling at a rolling reduction rate of 20% or less.

6. A method for making a steel sheet for double-rolled tubes, according to claim 5, the steel sheet comprising:

C: 0.0005–0.020 wt %,

Si: 0.10 wt % or less,

Mn: 0.1–1.5 wt %,

P: 0.02 wt % or less,

S: 0.02 wt % or less,

Al: 0.100 wt % or less, and

N: 0.0050 wt % or less; and further comprising one or two of

Nb: 0.003–0.040 wt %, and

Ti: 0.005–0.060 wt %; and the balance being Fe and incidental impurities.

7. A method for making a steel sheet for double-rolled tubes, according to claim 5, the steel sheet comprising:

C: 0.0005–0.020 wt %,

Si: 0.10 wt % or less,

Mn: 0.1–1.5 wt %,

P: 0.02 wt % or less,

S: 0.02 wt % or less,

Al: 0.100 wt % or less, and

N: 0.0050 wt % or less; and further comprising one or two of

Nb: 0.003–0.040 wt %, and

Ti: 0.005–0.060 wt %; and at least one selected from the group consisting of

B: 0.0005–0.0020 wt %,

Cu: 0.5 wt % or less,

Ni: 0.5 wt % or less,

Cr: 0.5 wt % or less, and

Mo: 0.5 wt % or less; and the balance being Fe and incidental impurities.

8. A steel sheet for double-rolled tubes, according to claim 2, comprising:

C: 0.0005–0.020 wt %,

Si: 0.10 wt % or less,

Mn: 0.1–1.5 wt %,

P: 0.02 wt % or less,

S: 0.02 wt % or less,

Al: 0.100 wt % or less, and

N: 0.0050 wt % or less; and further comprising one or two of

Nb: 0.003–0.040 wt %, and

Ti: 0.005–0.060 wt %; and the balance being Fe and incidental impurities.

9. A steel sheet for double-rolled tubes, according to claim 2, comprising:

C: 0.0005–0.020 wt %,

Si: 0.10 wt % or less,

Mn: 0.1–1.5 wt %,

P: 0.02 wt % or less,

S: 0.02 wt % or less,

Al: 0.100 wt % or less, and

N: 0.0050 wt % or less; and further comprising one or two of

Nb: 0.003–0.040 wt %, and

Ti: 0.005–0.060 wt %; and at least one selected from the group consisting of

B: 0.0005–0.0020 wt %,

Cu: 0.5 wt % or less,

Ni: 0.5 wt % or less,

Cr: 0.5 wt % or less, and

Mo: 0.5 wt % or less; and the balance being Fe and incidental impurities.

* * * * *